US007108443B2

(12) United States Patent
Chen

(10) Patent No.: US 7,108,443 B2
(45) Date of Patent: Sep. 19, 2006

(54) COUPLING DEVICE FOR A FOLDABLE FRAME

(75) Inventor: Shun-Min Chen, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 155 days.

(21) Appl. No.: 10/828,908

(22) Filed: Apr. 20, 2004

(65) Prior Publication Data

US 2005/0147463 A1 Jul. 7, 2005

(30) Foreign Application Priority Data

Jan. 6, 2004 (CN) ..... 2002 2 00018115

(51) Int. Cl.
*F16C 11/10* (2006.01)
*A47D 7/00* (2006.01)

(52) U.S. Cl. ..... 403/102; 5/99.1

(58) Field of Classification Search ..... 5/93.1, 5/93.2, 98.1, 99.1, 111, 114; 16/323, 325, 16/326, 342–346; 403/65, 81, 325, 100–102, 403/321, 322.1, 218, 322.3
See application file for complete search history.

(56) References Cited

U.S. PATENT DOCUMENTS 4,811,437 A 3/1989 Dillner et al. ..... 5/99.1
5,293,656 A 3/1994 Chan
5,483,710 A 1/1996 Chan
5,745,954 A 5/1998 Shogan et al.
5,761,755 A 6/1998 Huang
5,781,944 A * 7/1998 Huang ..... 5/99.1
5,857,229 A 1/1999 Magnani, Jr.
6,202,229 B1 3/2001 Cheng
2003/0061658 A1 4/2003 Longenecker

FOREIGN PATENT DOCUMENTS

CN 2544618 Y 4/2003
CN 2549837 Y 5/2003

* cited by examiner

*Primary Examiner*—Robert J. Sandy
*Assistant Examiner*—Ruth C. Rodriguez
(74) *Attorney, Agent, or Firm*—David N. Lathrop, Esq.; Gallagher & Lathrop

(57) ABSTRACT

A coupling device includes a coupling seat unit connected pivotally to pivot portions of two rod members of a foldable frame such that an engaging end portion of each rod member extends into an accommodating space of the coupling seat unit when the rod members are aligned with each other in an extended position. A spring-loaded latch unit is mounted movably in the accommodating space and is operable from an engaging position for retaining the rod members in the extended position to a releasing position for permitting movement of the rod members to a folded position. An actuating member has a connecting portion extending into the accommodating space and mounted movably on the coupling seat unit, and an actuating portion operably externally of the accommodating space for moving the actuating portion so as to drive the latch unit to move from the engaging position to the releasing position.

8 Claims, 7 Drawing Sheets

COUPLING DEVICE FOR A FOLDABLE FRAME

CROSS-REFERENCE TO RELATED APPLICATION

This application claims priority of Chinese Application No. 2004200018115, filed on Jan. 6, 2004.

BACKGROUND OF THE INVENTION

1. Field of the Invention

The invention relates to a coupling device for a foldable frame, more particularly to a coupling device for a foldable frame that can be operated with relative ease.

2. Description of the Related Art

FIGS. 1 to 4 illustrate a conventional coupling device for a foldable frame, such as a baby crib, disclosed in US 2003/0061658. The conventional coupling device includes a pair of elongate rod members 11, each of which has an engaging end portion 110, and a pivot portion 111 connected to the engaging end portion 110. The conventional coupling device interconnects pivotally the pivot portions 111 of the rod members 11 such that the rod members 11 are operable so as to move from an extended position, where the rod members 11 are aligned with each other in a horizontal direction (see FIG. 2), to a folded position, where the rod members 11 are generally parallel to each other and extend in a vertical direction (not shown).

The conventional coupling device includes a hollow coupling seat body 10, a spring-loaded latch unit 2, and an actuating member 3. The coupling seat body 10, which is configured with an accommodating space, has a top side, a bottom open side, and opposite lateral open sides that are connected pivotally and respectively to the pivot portions 111 of the rod members 11 such that the engaging end portion 110 of each rod member 11 extends into the accommodating space in the horizontal direction via a respective one of the lateral open sides when the rod members 11 are in the extended position, as shown in FIG. 2. The latch unit 2, which is mounted movably in the accommodating space of the coupling seat body 10, includes a pair of engaging blocks 20 spaced apart from each other in the horizontal direction. Each engaging block 20 has an upper coupling end portion formed with an engaging groove 200, and a lower pivot end portion opposite to the upper coupling end portion and connected pivotally to the coupling seat body 10 such that each engaging block 20 is rotatable relative to the coupling seat body 10 about a respective pivot axis transverse to the horizontal and vertical directions. Each engaging block 20 is formed with an engaging rib 22 that extends from the lower pivot end portion thereof toward the other engaging block 20. The latch unit 2 is operable from an engaging position, where the engaging grooves 200 of the upper coupling end portions of the engaging blocks 20 engage the engaging end portions 110 of the rod members 11 so as to retain the rod members 11 in the extended position, as shown in FIG. 2, to a releasing position, where the engaging grooves 200 of the upper coupling end portions of the engaging blocks 20 are unable to engage the engaging end portions 110 of the rod members 11 so as to permit movement of the rod members 11 from the extended position to the folded position, as shown in FIG. 4. The latch unit 2 further includes a coiled compression spring 21 interconnecting the upper coupling end portions of the engaging blocks 20 for restoring the latch unit 2 from the releasing position back to the engaging position. The actuating member 3 has an actuating portion 31 that extends into the accommodating space of the coupling seat body 10 via a front slot 101 in the coupling seat body 10, and that is mounted movably on the coupling seat body 10 via mounting pieces 13, 14 so as to be movable relative to the coupling seat body 10 in a transverse direction transverse to the horizontal and vertical directions, and an operating portion 30 connected to the actuating portion 31, disposed in front of the coupling seat body 10, and operable externally of the coupling seat body 10 for moving the actuating portion 31 along the transverse direction toward a rear side of the coupling seat body 10 such that a bevel plate 311 formed on the actuating portion 31 abuts against and drives the engaging ribs 22 on the engaging blocks 20 to move downwardly so as to enable the latch unit 2 to move from the engaging position to the releasing position.

The following are some of the drawbacks of the aforesaid conventional coupling device:

1. Since the engaging ribs 22 on the engaging blocks 20 are driven to move downwardly by the bevel plate 311 as a result of pressing the operating portion 30 of the actuating member 3 for moving the actuating portion 31 toward the rear side of the coupling seat body 10, a relatively greater amount of force is required to be exerted by the user.

2. Since the operating portion 30 of the actuating member 3 is disposed externally of the front side of the coupling seat body 10, accidental operation of the actuating member 3 is likely to occur.

3. Due to the presence of the engaging ribs 22, the mounting pieces 13, 14, and the bevel plate 311 on the actuating portion 31 of the actuating member 3, the conventional coupling device has a relatively complicated configuration.

SUMMARY OF THE INVENTION

Therefore, the object of the present invention is to provide a coupling device for a foldable frame that can overcome the aforesaid drawbacks of the prior art.

According to the present invention, there is provided a coupling device for a foldable frame that includes a pair of elongate rod members, each of which has an engaging end portion, and a pivot portion connected to the engaging end portion. The coupling device is adapted to interconnect pivotally the pivot portions of the rod members such that the rod members are operable so as to move from an extended position, where the rod members are aligned with each other in a first direction, to a folded position, where the rod members are generally parallel to each other and extend in a second direction generally transverse to the first direction. The coupling device comprises:

a coupling seat unit configured with an accommodating space and having a first open side and a second side opposite to each other in the second direction, and third and fourth open sides opposite to each other in the first direction and adapted to be connected pivotally and respectively to the pivot portions of the rod members such that the engaging end portion of each of the rod members extends into the accommodating space in the first direction via a respective one of the third and fourth open sides when the rod members are in the extended position and such that the engaging end portion of each of the rod members is disposed at the respective one of the third and fourth open sides;

a spring-loaded latch unit mounted movably in the accommodating space of the coupling seat unit, the latch unit being operable from an engaging position, where the latch unit is adapted to engage the engaging end portions of the rod members so as to retain the rod members in the extended position, to a releasing position, where the latch unit is unable to engage the engaging end portions of the rod members so as to permit movement of the rod members from the extended position to the folded position; and an actuating member having a connecting portion that extends into the accommodating space of the coupling seat unit via the first open side and that is mounted movably on the coupling seat unit so as to be movable relative to the coupling seat unit in the second direction, and an actuating portion connected to the connecting portion, disposed at the first open side of the coupling seat unit, and operable externally of the accommodating space for moving the actuating portion in the accommodating space along the second direction such that the actuating portion drives the latch unit to move from the engaging position to the releasing position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
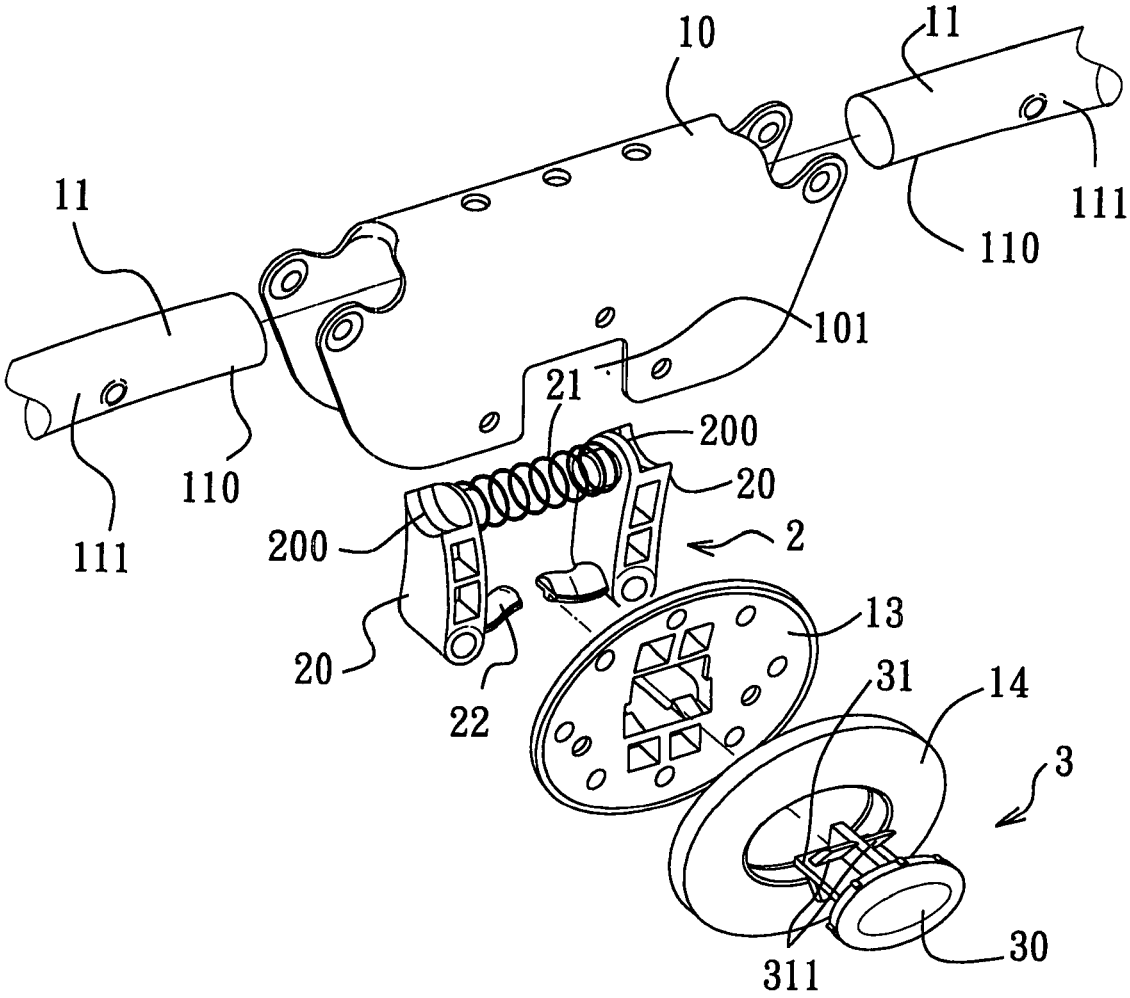
F I G. 1 PRIOR ART
FIG. 1 is an exploded fragmentary perspective view of a conventional coupling device for a foldable frame.
Figure 2:
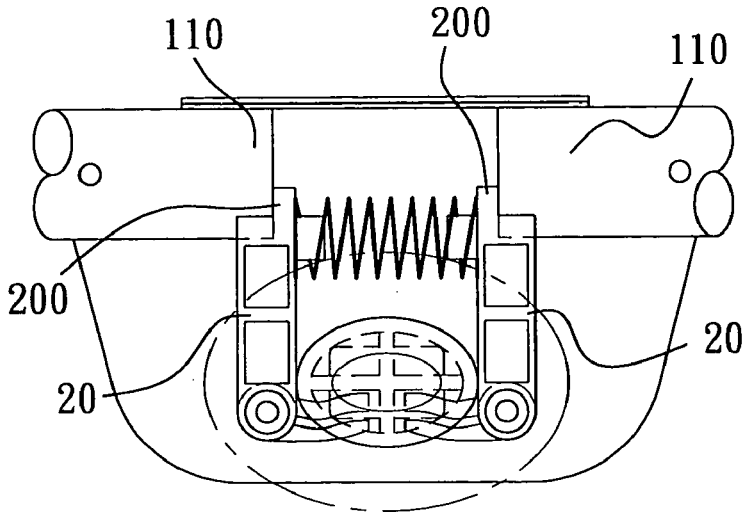
F I G. 2 PRIOR ART
FIG. 2 is a fragmentary schematic view showing the conventional coupling device when a latch unit engages rod members of the foldable frame so as to retain the latter in an extended position.
Figure 3:
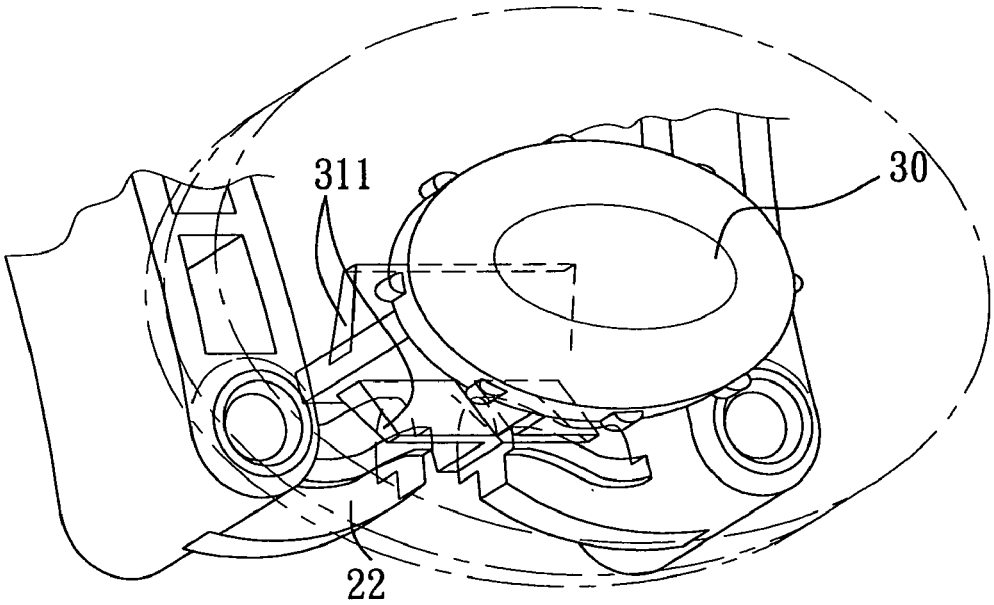
F I G. 3 PRIOR ART
FIG. 3 is a fragmentary perspective view showing the latch unit and an actuating member of the conventional coupling device.
Figure 4:
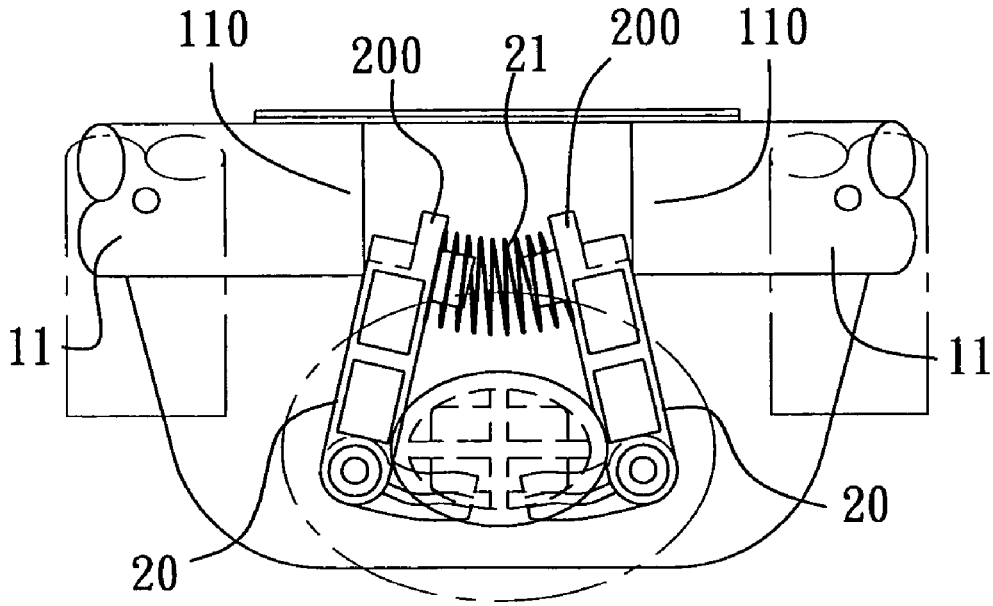
F I G. 4 PRIOR ART
FIG. 4 is a fragmentary schematic view showing the conventional coupling device when the latch unit disengages the rod members so as to permit folding of the foldable frame.
Figure 5:
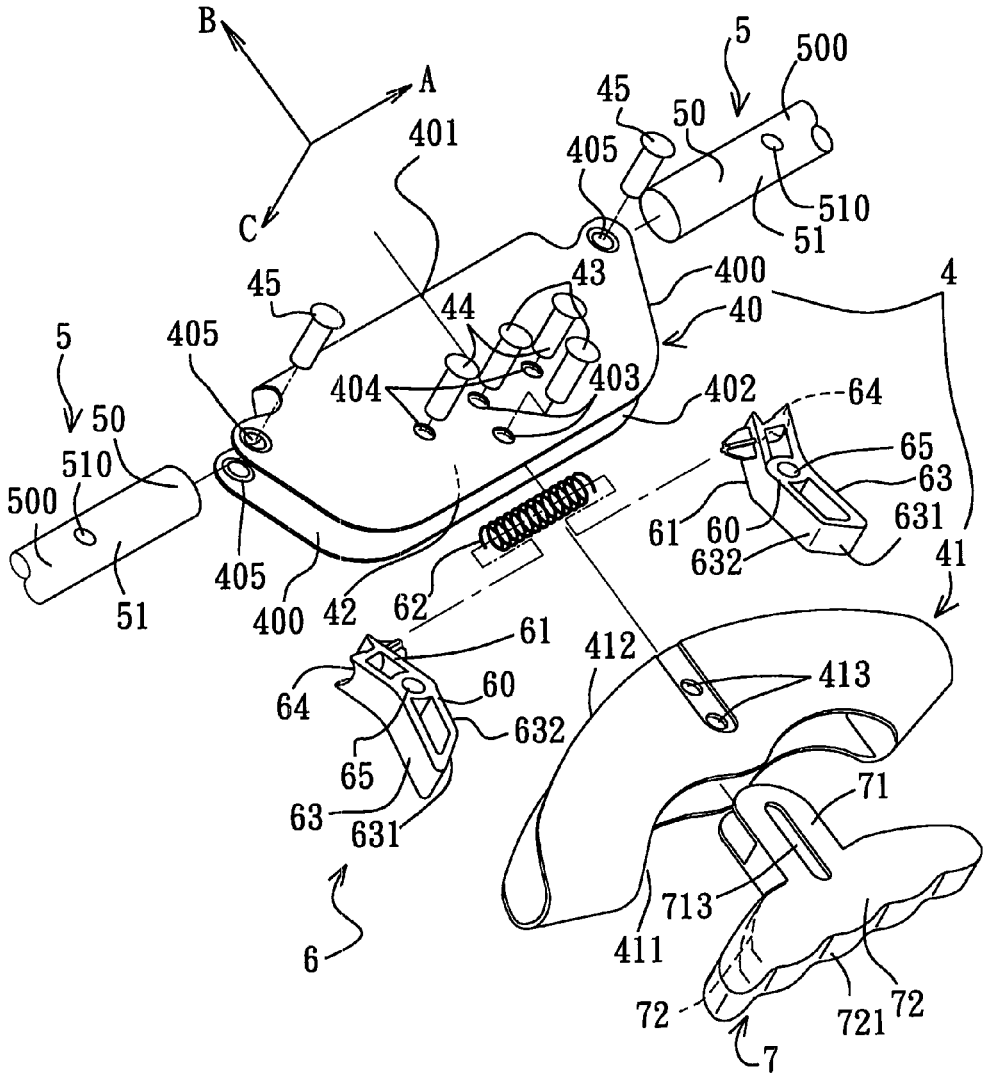
FIG. 5 is an exploded fragmentary perspective view showing the preferred embodiment of a coupling device for a foldable frame according to the present invention.

Referring to FIGS. 5 to 8, according to the preferred embodiment of the present invention, a coupling device for a foldable frame 5 is shown. In this embodiment, the foldable frame 5, such as a baby crib, includes a pair of elongate rod members 500, each of which has an engaging end portion 50, and a pivot portion 51 connected to the engaging end portion 50. The coupling device is adapted to interconnect pivotally the pivot portions 51 of the rod members 500 such that the rod member 500 are operable so as to move from an extended position, where the rod members 500 are aligned with each other in a first direction (A) (see FIG. 6), to a folded position, where the rod members 500 are generally parallel to each other and extend in a second direction (B) generally transverse to the first direction (A) (see FIG. 8). The coupling device includes a coupling seat unit 4, a spring-loaded latch unit 6, and an actuating member 7.

The coupling seat unit 4 is configured with an accommodating space 42, and has a first open side 411 and a second side 401 opposite to each other in the second direction (B), and third and fourth open sides 400 opposite to each other in the first direction (A) and adapted to be connected pivotally and respectively to the pivot portions 51 of the rod members 500 such that the engaging end portion 50 of each of the rod members 500 extends into the accommodating space 42 in the first direction (A) via a respective one of the third and fourth open sides 400 when the rod members 500 are in the extended position and such that the engaging end portion 50 of each of the rod members 500 is disposed at the respective one of the third and fourth open sides 400. In this embodiment, the coupling seat unit 4 includes a hollow male seat body 40 and a hollow female seat body 41. The male seat body 40 has the third and fourth open sides 400, the second side 401, and a fifth open side 402 opposite to the second side 401 in the second direction (B). The female seat body 41 has the first open side 411 and a sixth open side 412 opposite to the first open side 411 in the second direction (B). The female seat body 41 is mounted and sleeved on the male seat body 40 such that the female seat body 41 cooperates with the male seat body 40 so as to confine the accommodating space 42. In this embodiment, the female seat body 41 is fixed to the male seat body 40 by a pair of rivets 43 spaced apart from each other in the second direction (B) and extending through a pair of through holes 403 in the male seat body 40 and a pair of through holes 413 in the female seat body 41. Each of the third and fourth open sides 400 is adapted to connect pivotally with a respective one of the pivot portions 51 of the rod members 500 by means of a respective rivet 45 that extends through two pivot holes 405 formed in each of the third and fourth open sides 400 and opposite to each other in a third direction (C) transverse to the first and second directions (A, B), and a through hole 510 in the respective one of the pivot portions 51 of the rod members 500.

The latch unit 6 is mounted movably in the accommodating space 42 of the coupling seat unit 4. The latch unit 6 is operable from an engaging position, where the latch unit 6 is adapted to engage the engaging end portions 50 of the rod members 500 so as to retain the rod members 500 in the extended position (see FIG. 6), to a releasing position, where the latch unit 6 is unable to engage the engaging end portions 50 of the rod members 500 (see FIG. 7) so as to permit movement of the rod members 500 from the extended position to the folded position (see FIG. 8). In this embodiment, the latch unit 6 includes a pair of engaging blocks 60 and a biasing piece 62.

Figure 6:
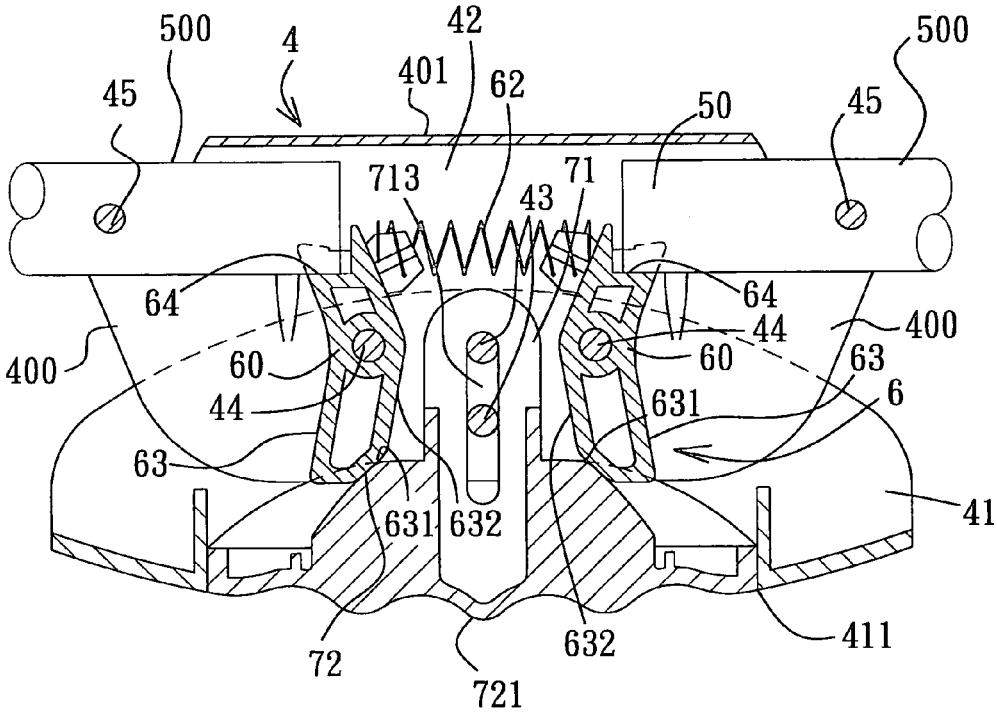
FIG. 6 is a fragmentary schematic partly sectional view showing the preferred embodiment when a latch unit engages rod members of the foldable frame so as to retain the latter in an extended position.
Figure 7:
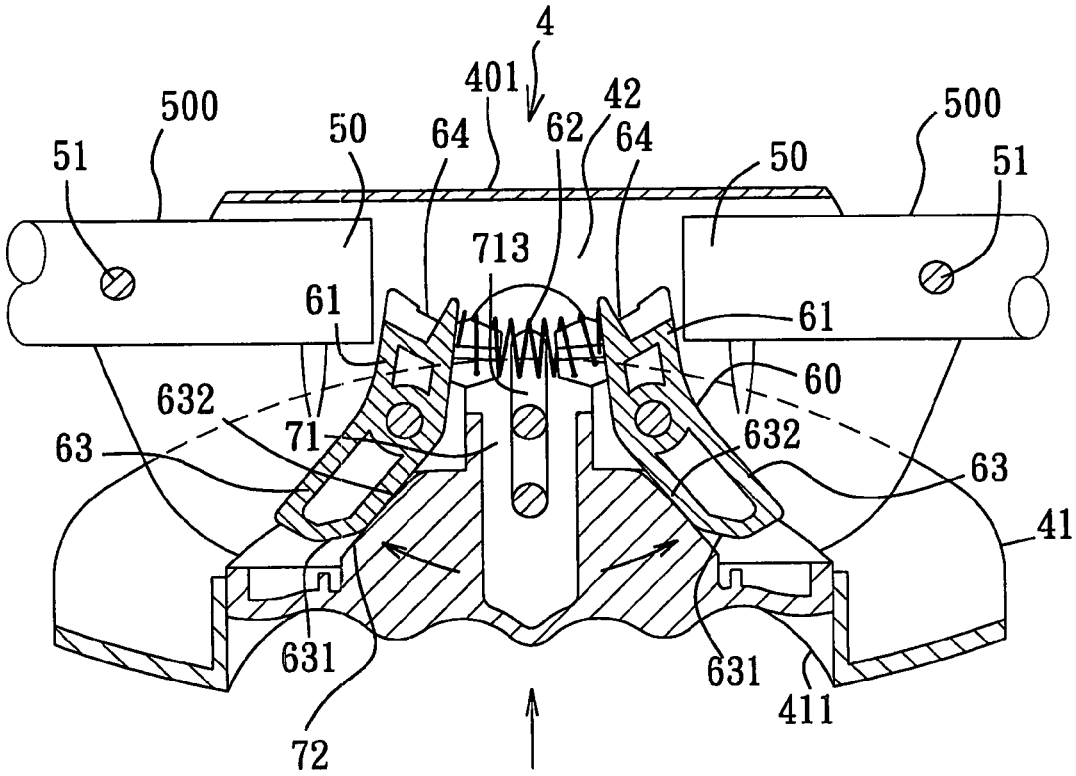
FIG. 7 is a fragmentary schematic partly sectional view showing the preferred embodiment when the latch unit disengages the rod members so as to permit folding of the foldable frame.
Figure 8:
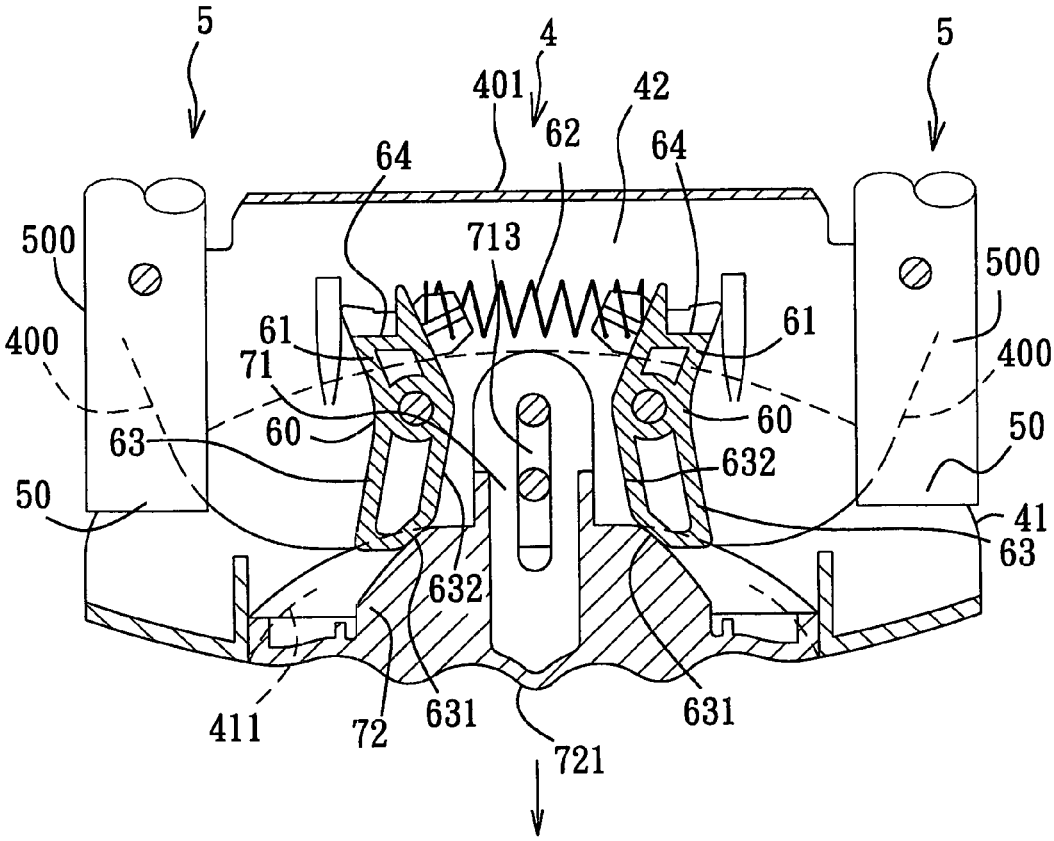
FIG. 8 is a fragmentary schematic sectional view showing the preferred embodiment when the rod members of the foldable frame are in the folded position.

The engaging blocks 60 are spaced apart from each other in the first direction (A). Each engaging block 60 is retained rotatably in the accommodating space 42 by means of a respective rivet 44 that extends through opposite mounting holes 404 in the male seat body 40 and a through hole 65 in the engaging block 60, and is rotatable relative to the coupling seat unit 4 about a respective pivot axis transverse to the first and second directions (A, B). Each engaging block 60 has an engaging portion 61 adjacent to the second side 401 of the coupling seat unit 4, and an abutting portion 63 opposite to the engaging portion 61 in the second direction (B). The engaging portions 61 of the engaging blocks 60 move toward each other in the first direction (A), and the abutting portions 63 of the engaging blocks 60 move away from each other in the first direction (A) when the latch unit 6 is moved from the engaging position to the releasing position, as shown in FIG. 7. In this embodiment, the engaging portion 61 of each engaging block 60 is formed with an engaging groove 64 adapted to engage the engaging end portion 50 of a respective one of the rod members 500, as shown in FIG. 6. The abutting portion 63 of each engaging block 60 is formed with a first bevel face 631 and a second bevel face 632.

The biasing piece 62 interconnects the engaging portions 61 of the engaging blocks 60, and provides a restoring force for restoring the latch unit 6 from the releasing position back to the engaging position. In this embodiment, the biasing piece 62 is a coiled compression spring.

The actuating member 7 has a connecting portion 71 and an actuating portion 72. The connecting portion 71 extends into the accommodating space 42 of the coupling seat unit 4 via the first open side 411 of the female seat body 41 and the fifth open side 402 of the male seat body 40, and is mounted movably on the coupling seat unit 4 so as to be movable relative to the coupling seat unit 4 in the second direction (B). In this embodiment, the connecting portion 71 is formed with a guiding groove 713 extending in the second direction (B). The rivets 43, which serve as guiding projections, further extend into the guiding groove 713 to guide movement of the actuating member 7 in the second direction (B). The actuating portion 72 is connected to the connecting portion 71, is disposed at the first open side 411 of the coupling seat unit 4, and is operable externally of the accommodating space 42 for moving the actuating portion 72 in the accommodating space 42 along the second direction (B) such that the actuating portion 72 drives the latch unit 6 to move from the engaging position to the releasing position. In this embodiment, the first bevel face 631 of the abutting portion 63 of each engaging block 60 abuts against the actuating portion 72 when the latch unit 6 is at the engaging position, as shown in FIG. 6, and the second bevel face 632 of the abutting portion 63 of each engaging block 60 abuts against the actuating portion 72 when the actuating portion 72 is moved into the accommodating space 42 of the coupling seat unit 4 via the first open side 411 of the female seat body 41 and the fifth open side 402 of the male seat body 40, as shown in FIG. 7. Moreover, the actuating portion 72 has an undulated operating surface 721 remote from the connecting portion 71 in the second direction (B) to facilitate user operation of the actuating member 7.

It is noted that, due to the configuration of the first and second bevel faces 631, 632 of the abutting portion 63 of each engaging block 60 and the actuating portion 72 of the actuating member 7, the coupling device of this invention has a relatively simple construction. Furthermore, since the actuating member 7 is mounted movably in the first open side 411 of the coupling seat unit 4 (the first open side 411 being a bottom side in this embodiment), handling of the actuating portion 72 of the actuating member 7 by the user is facilitated, and accidental operation of the actuating member 7 can be avoided.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A coupling device for a foldable frame that includes a pair of elongate rod members, each of which has an engaging end portion, and a pivot portion connected to the engaging end portion, said coupling device being adapted to interconnect pivotally the pivot portions of the rod members such that the rod members are operable so as to move from an extended position, where the rod members are aligned with each other in a first direction, to a folded position, where the rod members are generally parallel to each other and extend in a second direction generally transverse to the first direction, said coupling device comprising:

a coupling seat unit configured with an accommodating space and having a first open side and a second side opposite to each other in the second direction, and third and fourth open sides opposite to each other in the first direction and adapted to be connected pivotally and respectively to the pivot portions of the rod members such that the engaging end portion of each of the rod members extends into said accommodating space in the first direction via a respective one of said third and fourth open sides when the rod members are in the extended position and such that the engaging end portion of each of the rod members is disposed at the respective one of said third and fourth open sides;

a spring-loaded latch unit mounted movably in said accommodating space of said coupling seat unit, said latch unit being operable from an engaging position, where said latch unit is adapted to engage the engaging end portions of the rod members so as to retain the rod members in the extended position, to a releasing position, where said latch unit is unable to engage the engaging end portions of the rod members so as to permit movement of the rod members from the extended position to the folded position; and an actuating member having a connecting portion that extends into said accommodating space of said coupling seat unit via said first open side and that is mounted movably on said coupling seat unit so as to be movable relative to said coupling seat unit in the second direction, and an actuating portion connected to said connecting portion, disposed at said first open side of said coupling seat unit, and operable externally of said accommodating space for moving said actuating portion in said accommodating space along the second direction such that said actuating portion drives said latch unit to move from the engaging position to the releasing position;

wherein said coupling seat unit comprises:

a hollow male seat body having said third and fourth open sides, said second side, and a fifth open side opposite to said second side in the second direction; and a hollow female seat body having said first open side, and a sixth open side opposite to said first open side in the second direction, said female seat body being sleeved on said male seat body such that said male seat body cooperates with said female seat body so as to confine said accommodating space.

2. The coupling device as claimed in claim 1, wherein said male seat body is fixed to said female seat body by a pair of rivets spaced apart from each other in the second direction.

3. The coupling device as claimed in claim 1, wherein said connecting portion of said actuating member is formed with a guiding groove extending in the second direction, and said coupling seat unit is formed with at least a guiding projection that extends into said guiding groove to guide movement of said actuating member in the second direction.

4. The coupling device as claimed in claim 1, wherein said latch unit further comprises:

a pair of engaging blocks spaced apart from each other in the first direction, each of said engaging blocks being retained rotatably in said accommodating space and being rotatable relative to said coupling seat unit about a respective pivot axis transverse to the first and second directions, each of said engaging blocks having an engaging portion adjacent to said second side of said coupling seat unit, and an abutting portion opposite to said engaging portion in the second direction, said engaging portions of said engaging blocks moving toward each other in the first direction, and said abutting portions of said engaging blocks moving away from each other in the first direction when said latch unit is moved from the engaging position to the releasing position, said engaging portion of each of said engaging blocks being formed with an engaging groove adapted to engage the engaging end portion of a respective one of the rod members, said abutting portion of each of said engaging blocks being formed with a first bevel face that abuts against said actuating portion of said actuating member when said latch unit is at the engaging position, and a second bevel face that abuts against said actuating portion of said actuating member when said actuating portion is moved into said accommodating space of said coupling seat unit via said first open side; and a biasing piece interconnecting said engaging portions of said engaging blocks and providing a restoring force for restoring said latch unit from the releasing position back to the engaging position.

5. The coupling device as claimed in claim 4, wherein said biasing piece is a coiled compression spring.

6. The coupling device as claimed in claim 1, wherein said actuating portion of said actuating member has an undulated operating surface remote from said connecting portion in the second direction.

7. A coupling device for a foldable frame that includes a pair of elongate rod members, each of which has an engaging end portion, and a pivot portion connected to the engaging end portion, said coupling device being adapted to interconnect pivotally the pivot portions of the rod members such that the rod members are operable so as to move from an extended position, where the rod members are aligned with each other in a first direction, to a folded position, where the rod members are generally parallel to each other and extend in a second direction generally transverse to the first direction, said coupling device comprising:

a coupling seat unit configured with an accommodating space and adapted to be connected pivotally and respectively to the pivot portions of the rod members such that the engaging end portion of each of the rod members extends into said accommodating space in the first direction when the rod members are in the extended position;

a spring-loaded latch unit mounted movably in said accommodating space of said coupling seat unit, said latch unit being operable from an engaging position, where said latch unit is adapted to engage the engaging end portions of the rod members so as to retain the rod members in the extended position, to a releasing position, where said latch unit is unable to engage the engaging end portions of the rod members so as to permit movement of the rod members from the extended position to the folded position; and an actuating member having a connecting portion that extends into said accommodating space of said coupling seat unit so as to be movable relative to said coupling seat unit in the second direction, and an actuating portion connected to said connecting portion, disposed at said coupling seat unit, and operable externally of said accommodating space for moving said actuating portion in said accommodating space along the second direction such that said actuating portion drives said latch unit to move from the engaging position to the releasing position;

wherein said latch unit comprises:

a pair of engaging blocks spaced apart from each other in the first direction, each of said engaging blocks being rotatable relative to said coupling seat unit about a respective pivot axis transverse to the first and second directions, each of said engaging blocks having an engaging portion adapted to be disposed adjacent to the engaging end portion of a respective one of the rod members, and an abutting portion opposite to said engaging portion in the second direction, said abutting portion of each of said engaging blocks being formed with a first bevel face that abuts against said actuating portion of said actuating member when said latch unit is at the engaging position, and a second bevel face that abuts against said actuating portion of said actuating member when said actuating portion is moved into said accommodating space of said coupling seat unit.

8. A coupling device for a foldable frame that includes a pair of elongate rod members, each of which has an engaging end portion, and a pivot portion connected to the engaging end portion, said coupling device being adapted to interconnect pivotally the pivot portions of the rod members such that the rod members are operable so as to move from an extended position, where the rod members are aligned with each other in a first direction, to a folded position, where the rod members are generally parallel to each other and extend in a second direction generally transverse to the first direction, said coupling device comprising:

a coupling seat unit configured with an accommodating space and having a first open side and a second side opposite to each other in the second direction, and third and fourth open sides opposite to each other in the first direction and adapted to be connected pivotally and respectively to the pivot portions of the rod members such that the engaging end portion of each of the rod members extends into said accommodating space in the first direction via a respective one of said third and fourth open sides when the rod members are in the extended position and such that the engaging end portion of each of the rod members is disposed at the respective one of said third and fourth open sides;

a spring-loaded latch unit mounted movably in said accommodating space of said coupling seat unit, said latch unit being operable from an engaging position, where said latch unit is adapted to engage the engaging end portions of the rod members so as to retain the rod members in the extended position, to a releasing position, where said latch unit is unable to engage the engaging end portions of the rod members so as to permit movement of the rod members from the extended position to the folded position; and an actuating member having a connecting portion that extends into said accommodating space of said coupling seat unit via said first open side and that is mounted movably on said coupling seat unit so as to be movable relative to said coupling seat unit in the second direction, and an actuating portion connected to said connecting portion, disposed at said first open side of said coupling seat unit, and operable externally of said accommodating space for moving said actuating portion in said accommodating space along the second direction such that said actuating portion drives said latch unit to move from the engaging position to the releasing position;

wherein said latch unit comprises:

a pair of engaging blocks spaced apart from each other in the first direction, each of said engaging blocks being rotatable relative to said coupling seat unit about a respective pivot axis transverse to the first and second directions, each of said engaging blocks having an engaging portion adjacent to said second side of said coupling seat unit, and an abutting portion opposite to said engaging portion in the second direction, said abutting portion of each of said engaging blocks being formed with a first bevel face that abuts against said actuating portion of said actuating member when said latch unit is at the engaging position, and a second bevel face that abuts against said actuating portion of said actuating member when said actuating portion is moved into said accommodating space of said coupling seat unit via said first open side.

* * * * *